US006781581B1

(12) United States Patent
Lee

(10) Patent No.: US 6,781,581 B1
(45) Date of Patent: Aug. 24, 2004

(54) APPARATUS FOR INTERFACING TIMING INFORMATION IN DIGITAL DISPLAY DEVICE

(75) Inventor: Ji Hyun Lee, Seoul (KR)

(73) Assignee: Edtech Co., Ltd., Seoul (KR)

( * ) Notice: Subject to any disclaimer, the term of this patent is extended or adjusted under 35 U.S.C. 154(b) by 0 days.

(21) Appl. No.: 09/543,276

(22) Filed: Apr. 5, 2000

(30) Foreign Application Priority Data

Apr. 6, 1999 (KR) ..... 1999-11876

(51) Int. Cl.[7] ..... G09G 5/00
(52) U.S. Cl. ..... 345/213; 345/210; 345/215
(58) Field of Search ..... 345/99, 523, 600, 345/634, 661, 698, 210–215; 707/500.1; 348/552, 511; 386/46

(56) References Cited

U.S. PATENT DOCUMENTS 5,227,863 A * 7/1993 Bilbrey et al. ..... 348/578
5,576,769 A * 11/1996 Lendaro ..... 348/511
5,594,467 A * 1/1997 Marlton et al. ..... 345/213
5,715,020 A * 2/1998 Kuroiwa et al. ..... 348/734
5,796,392 A * 8/1998 Eglit ..... 345/213
5,847,691 A * 12/1998 Mistrot ..... 348/552
5,920,361 A * 7/1999 Gibeau et al. ..... 348/750
6,046,734 A * 4/2000 Noguchi et al. ..... 345/213
6,049,316 A * 4/2000 Nolan et al. ..... 345/698
6,107,984 A * 8/2000 Naka et al. ..... 345/99
6,157,376 A * 12/2000 Eglit ..... 345/213
6,177,922 B1 * 1/2001 Schiefer et al. ..... 345/132
6,223,283 B1 * 4/2001 Chaiken et al. ..... 713/1
6,232,952 B1 * 5/2001 Eglit ..... 345/134
6,271,822 B1 * 8/2001 Chiang ..... 345/99
6,453,110 B1 * 9/2002 Kawamura et al. ..... 386/46

* cited by examiner

*Primary Examiner*—Bipin Shalwala
*Assistant Examiner*—Prabodh M. Dharia
(74) *Attorney, Agent, or Firm*—Lee, Hong, Degerman, Kang & Schmadeka

(57) ABSTRACT

A timing information interfacing apparatus in a digital display device is provided to convert a timing information of a video signal generating unit to a timing information which is substantially requested by a display unit and transmit the converted timing information to the display unit. The timing information interfacing apparatus includes: an decoder for encoding a synchronous signal which is output from the video signal generating part and outputting a multiplexed synchronous signal in which a timing information data is carried; a decoder for decoding the multiplexed synchronous signal of the decoder to separate the synchronous signal and the information signal from the multiplexed synchronous signal and then outputting a demultiplexed timing information data carried in the synchronous signal; and a MICOM for controlling a sampling clock of a phase-locked loop and zoom up/down rates and horizontal/vertical positions of a display signal transforming part depending on the timing information data which is output from the decoder.

10 Claims, 7 Drawing Sheets

APPARATUS FOR INTERFACING TIMING INFORMATION IN DIGITAL DISPLAY DEVICE

BACKGROUND OF THE INVENTION

1. Field of the Invention

The present invention generally relates to a video signal generating apparatus, and more particularly to an apparatus for interfacing timing information in a digital display device.

2. Description of the Related Art

Hereinafter, a conventional apparatus for interfacing timing information in a digital display device is described with reference to the accompanying drawing.

FIG. 1 is a block diagram of an apparatus for interfacing timing information in a digital display device in accordance with the conventional art. Referring to FIG. 1, the apparatus includes; a video signal generating unit 1 for generating a video signal of R, G, and B and horizontal and vertical synchronizing signals of H and V; and a display unit 2 for recovering the video signal of R, G and B and the horizontal and vertical synchronizing signals generated from the video signal generating unit 1 to original signals and displaying the recovered signals on a display device 2*j*.

The video signal generating unit 1 includes: a video signal generating part 1*a* for generating a video signal of R, G and B and horizontal and vertical synchronizing signals of H and V; and a first interfacing part 1*b* for interfacing a display information of the display unit 2 depending on a control signal of the video signal generating part 1*a* or a control processing unit (not shown).

The display unit 2 storing the display information includes: a second interfacing part 2*b* for interfacing the stored display information depending on an output signal of the video signal generating unit 1; a video signal processing part 2*c* for transforming the video signal of R, G and B which is transmitted from the video signal generating unit 1 through a connector 2*a* to a video signal having a level corresponding to an input level of an analog/digital converting part 2*g* and outputting the level-transformed video signal; a synchronous signal processing part 2*d* for performing the polarity determination of the horizontal/vertical synchronous signal(H and V) which are transmitted from the video signal generating unit 1 through the connector 2*a*, the synchronous separation and the analysis of the synchronous signals; a MICOM 2*e* for analyzing a processing result of the synchronous signal processing part 2*d*, predicting timing information of the input video signals (R, G and B), and then outputting control signals corresponding thereto, thereby controlling whole operation of the system; a phase-locked loop 2*f* for generating a sampling clock of SC corresponding to the horizontal synchronous signal which is separated through the synchronous signal processing part 2*d* depending on the control signal of the MICOM 2*e*; an analog/digital converting part 2*g* for converting an analog video signal (ARGB) to a corresponding digital video signal (DRGB) to the analog video signal depending on the sampling clock SC of the phase-locked loop 2*f*; and a display signal converting part 2*h* for converting the digital video signal (DRGB) to be matched with an operational property of a display device 2*j*, which is converted by the analog/digital converting part 2*g*.

The above constituted conventional timing information interfacing apparatus of the digital display device is described with reference to the accompanying drawing of FIG. 1.

First, the video signal generating unit 1 generates a predetermined video signals(R, G and B) and horizontal/vertical synchronous signal (H and V). In other words, the video signal generating part 1*a* of the video signal generating unit 1 outputs a control signal to interface the display information of the display unit 2. Here, the control signal for interfacing the display information may be applied directly by the CPU(not shown) to the first interfacing part 1*b*.

The first interfacing part 1*b* interfaces the display information of the display unit 2 depending on the control signal of the video signal generating part 1*a* or a control signal of the CPU.

Accordingly, the video signal generating part 1*a* generates a predetermined video signals(R, G, B) adapted to the whole display information of the display unit 2 which has been interfaced through the first interfacing part 1*b*.

Then, the display unit 2 recovers the video signals(R, G, B) and the horizontal/vertical synchronous signals output from the video signal generating unit 1 to the original signals and displays the recovered original video signal on the display device 2*j*.

In other words, the second interfacing part 2*b* of the display unit 2 stores all the display information and interfaces the stored display information depending on the horizontal/vertical synchronous signal of the video signal generating unit 1.

Thereafter, the video signal processing part 2*c* outputs the video signal of R, G and B which is transmitted from the video signal generating part 1*a* of the video signal generating unit 1 through the connector 2*a* and which is converted to correspond to the input level of the analog/digital converting part 2*g*.

The synchronous signal processing part 2*d* performs the polarity determination of the horizontal/vertical synchronous signal(H and V) which are transmitted from the video signal generating unit 1 through the connector 2*a*, the separation of the synchronous signals and the analysis of the synchronous signals, and outputs the resultant signals.

Afterwards, the MICOM 2*e* analyze the signal processing result of the synchronous signal processing part 2*d*, predict the timing information of the input video signals(R, G, B), and then outputs a control signal corresponding thereto.

Then, the phase-locked loop 2*f* generates the sampling clock of SC corresponding to the horizontal synchronous signal which is separated through the synchronous signal processing part 2*d* depending on the control signal of the MICOM 2*e*.

Accordingly, the analog/digital converting part 2*g* converts an analog video signal(ARGB) which has been processed in the video signal processing part 2*c* to a corresponding digital video signal(DRGB) to the analog video signal depending on the sampling clock SC of the phase-locked loop 2*f*, and outputs the converted digital video signal(DRGB).

Then, the display signal converting part 2*h* converts the digital video signal(DRGB) to be matched with an operational property of a display device 2*j*, which is converted by the analog/digital converting part 2*g*, and a third interfacing part 2*i* interfaces the converted digital video signal to display the interfaced digital video signal through the display device 2*j*.

At this time, the MICOM 2*e* controls the sampling clock SC of the phase-locked loop 2*f* depending on the signal output from the display signal converting part 2*h*.

The above sequences are repeatedly performed, to thereby display predetermined information to be employed to devices.

Thus, in the conventional timing information interfacing apparatus, the video signal generating unit outputs only video signal and synchronous signals while interfacing signals between the video signal generating unit and the display unit, and the display unit receives these video signal and synchronous signals, analyzes the synchronous signals provided from the video signal generating unit, and predicts the timing information of the video signal. Therefore, based on the predicted timing information value, any video information can be displayed.

The predicted timing information value is, however, inaccurate since the real timing information is different every video signal generating devices. Accordingly, it is essentially required to interface more accurate timing information.

And, in the conventional timing information interfacing apparatus, the MICOM analyzes the synchronous signals and predicts the timing information data to control the phase-locked loop. Here, the predicted timing information data differs from the timing information data used for making the original analog video signal. Accordingly, since the sampling clock which is used by the analog/digital converting part becomes different, not only the conventional timing information interfacing apparatus uses an additive sampling clock varying means in order to control this difference but it is very difficult to control the sampling clock without using a specific video pattern.

Also, the conventional timing information interfacing apparatus has a drawback in that it is difficult to predict an active area only with the synchronous signals.

SUMMARY OF THE INVENTION

Accordingly, the present invention is provided to substantially obviate one or more of the problems due to limitations and disadvantages of the related art.

An object of the present invention is to provide a timing information interfacing apparatus of a digital display device to convert a timing information of a video signal generating unit to a timing information which is requested by a display unit using a digital display device and transmit the converted timing information to the display unit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a timing information interfacing apparatus in a digital display device comprising a video signal generating unit and a display unit according to the present invention, the interfacing apparatus comprises: an decoder for encoding a synchronous signal which is output from the video signal generating part and outputting a multiplexed synchronous signal in which a timing information data is carried; a decoder for decoding the multiplexed synchronous signal of the decoder to separate the synchronous signal and the information signal from the multiplexed synchronous signal and then outputting a demultiplexed timing information data carried in the synchronous signal; and a MICOM for controlling a sampling clock of a phase-locked loop and zoom up/down rates and horizontal/vertical positions of a display signal transforming part depending on the timing information data which is output from the decoder.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, preferred embodiments of a timing information interfacing apparatus in a digital display device in accordance with the present invention are described with reference to the accompanying drawings.

Figure 1:
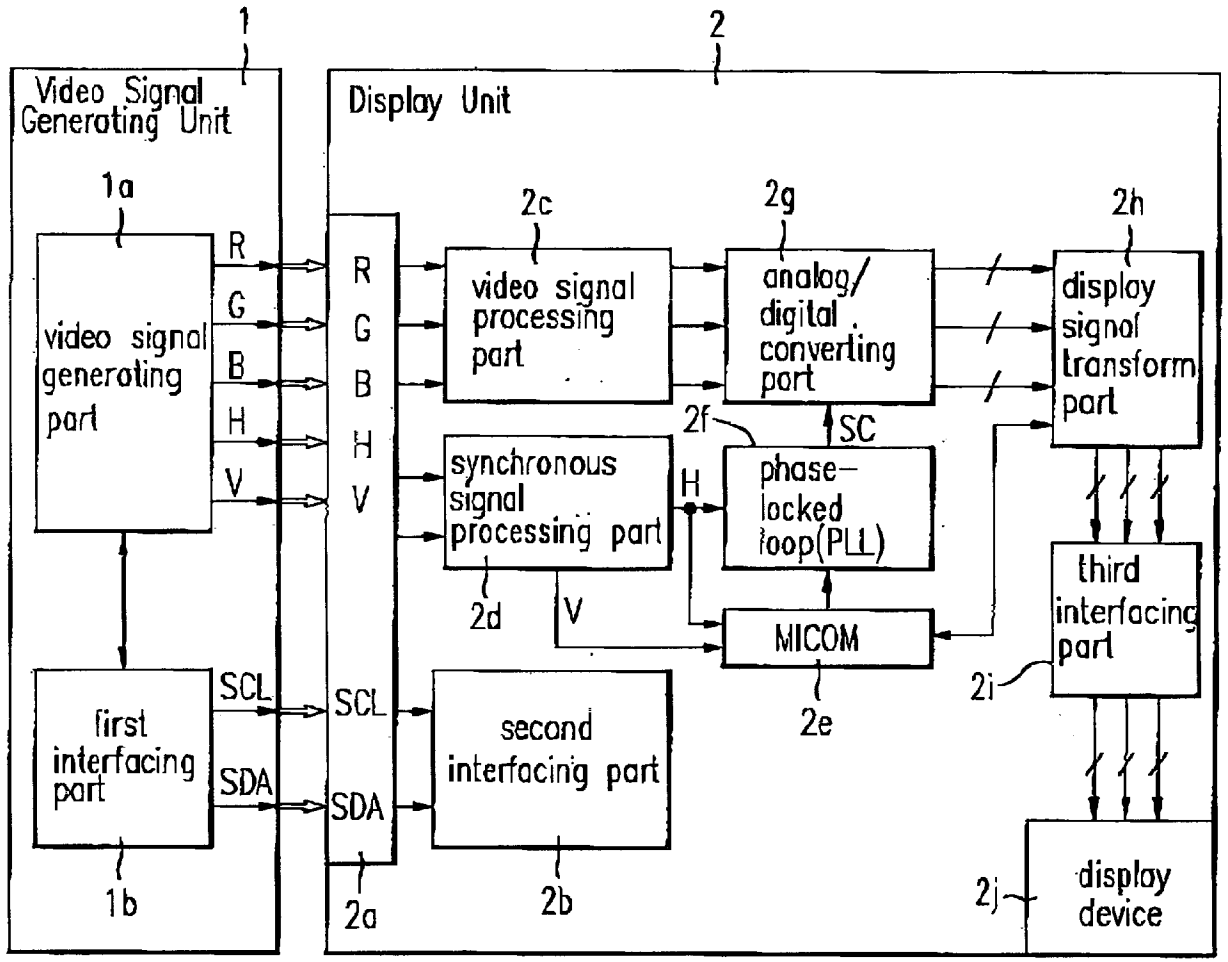
FIG. 1 Related Art
FIG. 1 is a block diagram of an apparatus for interfacing timing information in a digital display device in accordance with the conventional art.
Figure 2:
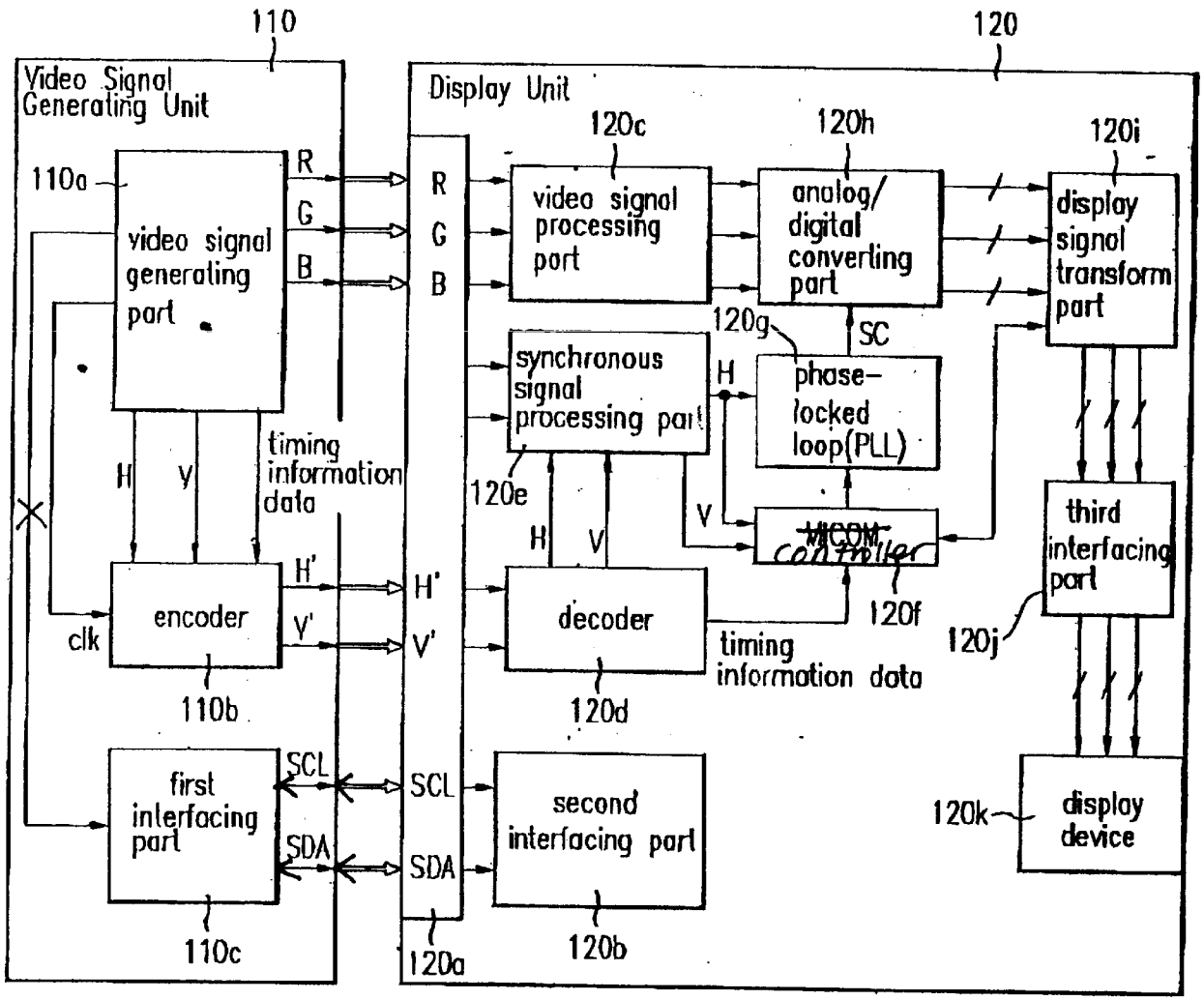
FIG. 2 is a block diagram of an apparatus for interfacing timing information in a digital display device in accordance with an embodiment of the present invention.

FIG. 2 is a block diagram showing a constitution of a timing interfacing apparatus in a digital display device in accordance with the present invention. The timing interfacing apparatus: a video signal generating unit 110 for generating a video signal of R, G, and B, horizontal and vertical synchronizing signals of H and V, and a timing information; and a display unit 120 for displaying the video signal of R, G and B depending on the timing information generated from the video signal generating part 110.

The video signal generating unit 110 includes: a video signal generating part 110*a* for generating a video signal of R, G and B, horizontal and vertical synchronizing signals of H and V, and an inner clock; an encoder 110*b* for encoding extra timing information data, which depends on the video signal generating part 110*a* and multiplexing the encoded timing information data to the vertical synchronous signal (V), thereby outputting multiplexed horizontal/vertical synchronous signals of H' and V'; and a first interfacing part 110*c* for interfacing the display information of the display unit 120 depending on a signal of the video signal generating part 110*a* or a control signal of a control processing unit(not shown).

The display unit 120 includes: a second interfacing part 120*b* for storing whole display information and interfacing the stored display information depending on a control signal of the video signal generating unit 110; a video signal processing part 120*c* for outputting the video signal of R, G and B which is transmitted from the video signal generating unit 110 through a connector 120*a* and then is converted to correspond to an input level of an analog/digital converting part 120*h*; a decoder 120*d* for de-multiplexing encoded timing information data from the vertical synchronous signal (V') which is transmitted through the connector 120*a*, then decoding encoded timing information data, outputting the de-multiplexed timing information data; a synchronous signal processing part 120*e* for performing the polarity determination of the horizontal/vertical synchronous signals(H and V) which are transmitted from the decoder 120*d*, the separation of the synchronous signals(H and V) and the analysis of the synchronous signals; a controller (also described herein as MICOM) [MICOM] 120*f* for controlling a sampling clock, zoom up/down rates and horizontal/vertical positions depending on the timing information data which is output from the decoder 120*d*; a phase-locked loop 120*g* for generating a sampling clock of SC corresponding to the horizontal synchronous signal(H) which is separated through the synchronous signal processing part 120*e* depending on the control signal of the MICOM 120*f*; an analog/digital converting part 120*h* for converting an analog video signal(ARGB) which is signal-processed by the video signal processing part 120*c* to a corresponding digital video signal(DRGB) to the analog video signal depending on the sampling clock SC of the phase-locked loop 120*g*; and a display signal transforming part 120*i* for transforming the converted digital video signal(DRGB) to be matched with an operational property of a display device 120*k*, which is converted by the analog/digital converting part 120*h*.

Figure 3A:
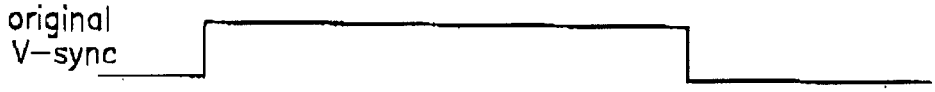
FIGS. 3*a* and 3*g* are waveforms of input and output signals on encoding of the encoding part of FIG. 2.
Figure 3B:
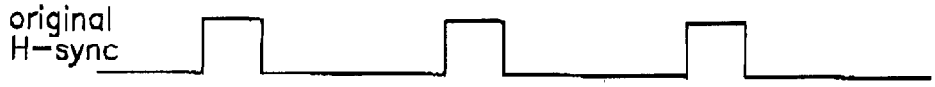
Figure 3C:
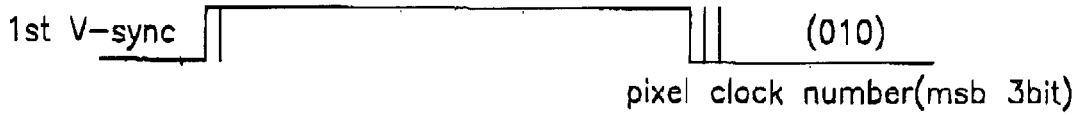
Figure 3D:
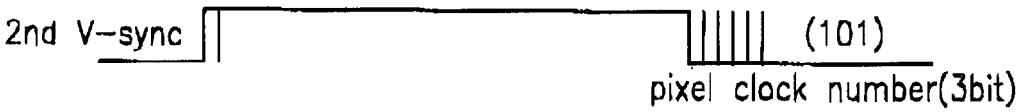
Figure 3E:
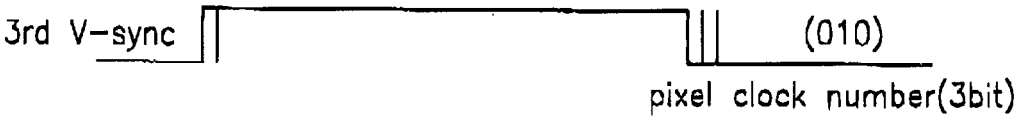
Figure 3F:
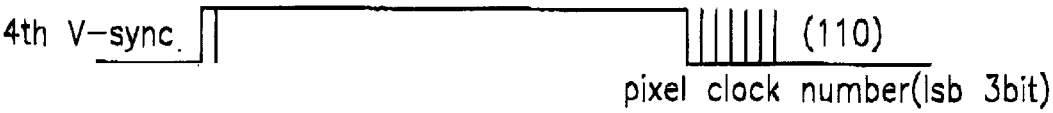
Figure 3G:
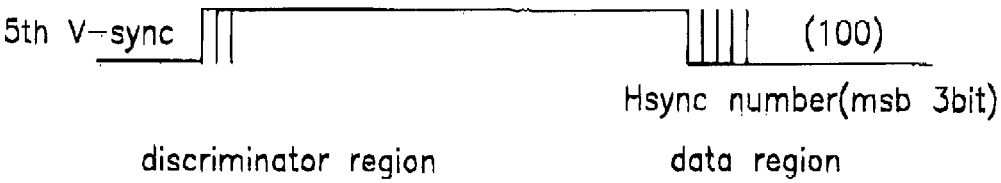
Figure 4A:
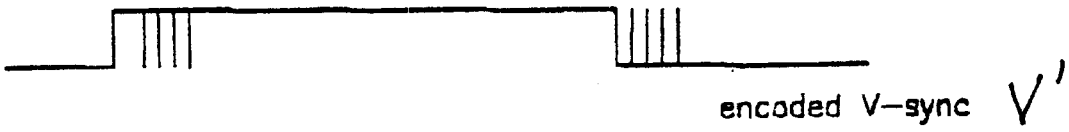
FIGS. 4*a* and 4*b* are waveforms of input and output signals on decoding of the decoding part of FIG. 2.
Figure 4B:
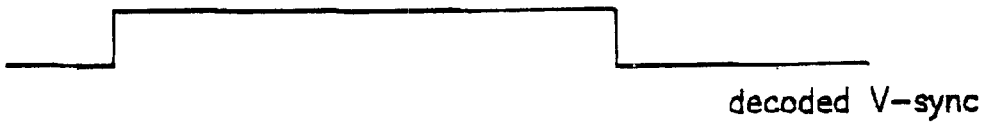

FIGS. 3*a* and 3*b* are waveforms of input and output signals on encoding of the decoder of FIG. 2 and FIGS. 4*a* and 4*b* are waveforms of input and output signals on decoding of the decoder of FIG. 2.

Figure 5:
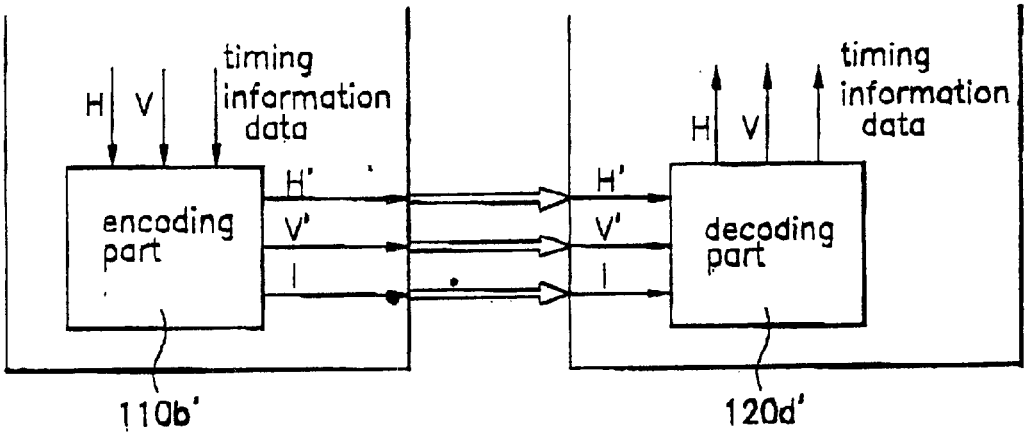
FIG. 5 is a block diagram of an apparatus for interfacing timing information in a digital display device in accordance with another embodiment of the present invention.
Figure 6A:
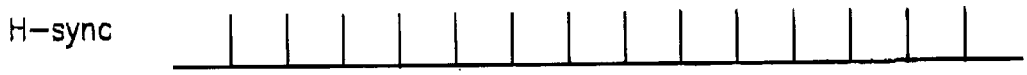
FIGS. 6*a* and 6*b* are waveforms of signals of the encoding part of FIG. 5.
Figure 6B:
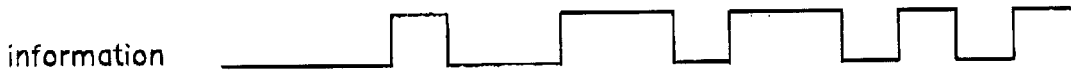

FIG. 5 is a block diagram of an apparatus for interfacing timing information in a digital display device in accordance with another embodiment of the present invention, and FIGS. 6*a* and 6*b* are waveforms of signals of the encoding part of FIG. 5.

Figure 7:
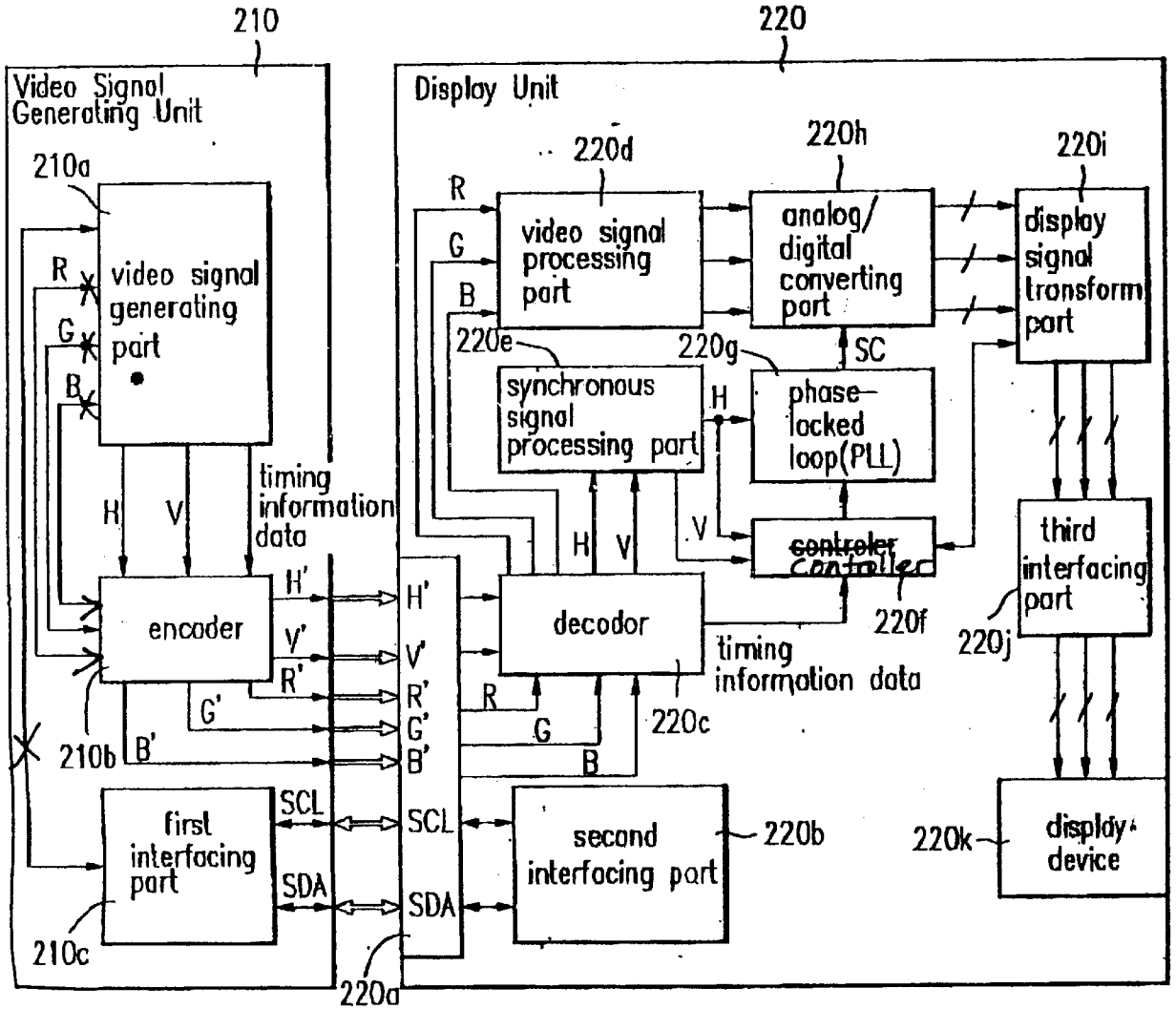
FIG. 7 is a block diagram of an apparatus for interfacing timing information in a digital display device in accordance with still another embodiment of the present invention.

FIG. 7 is a block diagram of an apparatus for interfacing timing information in a digital display device in accordance with still another embodiment of the present invention. The timing information interfacing apparatus includes: a video signal generating unit 210 for generating a video signal of R, G, and B, horizontal and vertical synchronizing signals of H and V, and a timing information; and a display unit 220 for signal-processing the video signal of R, G and B depending on the timing information generated from the video signal generating part 210 and displaying the signal-processed video signal.

The video signal generating unit 210 includes: a video signal generating part 210*a* for generating a video signal of R, G and B, horizontal and vertical synchronizing signals of H and V, and an inner clock; an encoder 210*b* for encoding the extra timing information data which depends on the video signal generating part 210*a* and multiplexing the encoded timing information data to the vertical synchronous signal, and then outputting the multiplexed video signals of R', G' and B' and horizontal/vertical synchronous signals of H' and V'; and a first interfacing part 210*c* for interfacing the display information stored in the display unit 220 depending on a signal of the video signal generating part 210*a* or a control signal of a control processing unit(not shown, "CPU").

The display unit 220 includes: a second interfacing part 220*b* for storing whole display information and interfacing the stored display information depending on a control signal of the video signal generating unit 210; a decoder 220*c* for de-multiplexing the encoded timing information data from the vertical synchronous signal(V') which is transmitted through the connector 220*a*, then decoding encoded timing information data, outputting the de-multiplexed timing information, the decoded video signals(R, G, B) and horizontal/vertical synchronous signals(H, V); a video signal processing part 220*d* for transforming the video signal of R, G and B which is output from the decoder 220*c* into the video signal which correspond to an input level of a following analog/digital converting part 220*h* and then outputting the transformed video signal; a synchronous signal processing part 220*e* for performing the polarity determination of the horizontal/vertical synchronous signals(H and V) which are transmitted from the decoder 220*c*, the separation of the synchronous signals(H and V) and the analysis of the synchronous signals (H and V); a MICOM 220*f* for controlling a sampling clock, zoom up/down rates and horizontal/vertical positions depending on the timing information data which is output from the decoder 220*c*; a phase-locked loop 220*g* for generating a sampling clock of SC corresponding to the horizontal synchronous signal(H) which is separated through the synchronous signal processing part 220*e* depending on the control signal of the MICOM 220*f*; an analog/digital converting part 220*h* for converting an analog video signal(ARGB) which is signal-processed by the video signal processing part 220*d* to a corresponding digital video signal(DRGB) to the analog video signal depending on the sampling clock SC of the phase-locked loop 220*g*; a display signal transforming part 220*i* for transforming the converted digital video signal(DRGB) to be matched with an operational property of a display device 220*k*, which is converted by the analog/digital converting part 220*h*; and a third interfacing part 220*j* for interfacing the output information of the display signal transforming part 220, wherein the output information is one to be displayed on the display device 220*k*.

Figure 8A:
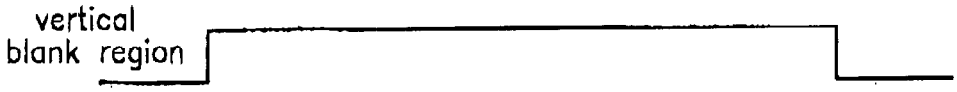
FIGS. 8*a* and 8*g* are waveforms of signals of the encoding part of FIG. 7.
Figure 8B:
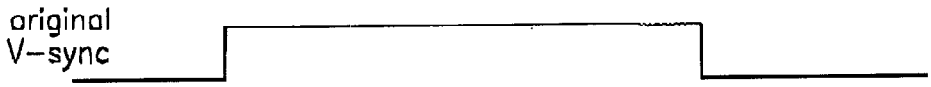

FIGS. 8*a* and 8*b* are waveforms signals of the encoding part of FIG. 7.

The operation of the above constituted timing information interfacing apparatus of the digital display device in accordance with the present invention is described with reference to the accompanying drawings of FIG. 2–FIG. 6*b*.

Referring to FIG. 2, first, the video signal generating unit 110 generates a predetermined video signals(R, G and B), horizontal/vertical synchronous signal(H and V), and a timing information, respectively. In other words, the video signal generating part 110*a* of the video signal generating unit 110 outputs a control signal to interface the display information of the display unit 120. Here, the control signal may be provided to the first interfacing part 110*c* directly from the CPU(not sown).

The first interfacing part 110*c* interfaces the display information of the display unit 120 depending on the control signal of the video signal generating part 110*a* or the control signal of the CPU.

Accordingly, the video signal generating part 110*a* generates a predetermined video signals(R, G, B), horizontal/vertical synchronous signal(H, V), and the timing information data according to the whole display information of the display unit 120 which has been interfaced through the first interfacing part 110*c*.

Here, the timing information data is comprised of an information data of total clocks carried in the horizontal synchronous signal (H), an information data of a number of total lines carried in the vertical synchronous signal (V), an information data of an active area carried respectively in the horizontal/vertical synchronous signals.

Next, the encoder 110*b* encodes the horizontal/vertical synchronous signals(H, V) and the timing information data which are output from the video signal generating part 110*a* according to the inner clock of the video signal generating part 110*a*, multiplexes the timing information data to the vertical synchronous signal(V'), and outputs the multiplexed horizontal/vertical synchronous signal(H' and V').

In other words, the encoder 110*b*, as shown in FIGS. 3*a* and 3*b*, encodes the horizontal/vertical synchronous signals (H, V) generated from the video signal generating part 110*a*, depending on the inner clock of the video signal generating part 110*a*, multiplexes a discriminator region of the timing information data within a delay region for determining the polarity of the vertical synchronous signal of one line by using the horizontal synchronous signal(H) as enable signal. After the vertical synchronous signal(V) within one line ends, the encoder 110*b* multiplexes the timing information data and outputs the multiplexed timing information data as shown in FIGS. 3*c*–3*g*.

Meanwhile, the encoder 110*b*, as shown in FIG. 5, encodes the horizontal/vertical synchronous signal(H, V) and the timing information data all generated from the video signal generating part 110*a*, using the horizontal synchronous signal(H) as the clock signal, and then outputs the horizontal/vertical synchronous signals(H, V) to the horizontal/vertical synchronous signal lines as shown in FIG. 6*a* and the timing information data to a newly formed information line as shown in FIG. 6*b*.

Here, all of header, mode, and data information can be contained in the information.

Then, the display unit 120 signal-processes the video signals(R, G, B) depending on the timing information generated from the video signal generating unit 110 and displays the signal-processed video signal.

In other words, the second interfacing part 120*b* of the display unit 120 stores all the display information within the display unit 120 and interfaces the stored display information depending on the control signal of the video signal generating unit 110.

Thereafter, the video signal processing part 120*c* transforms the video signal of R, G and B which is transmitted from the video signal generating part 110*a* of the video signal generating unit 110 through the connector 120*a* into a video signal corresponding to the input level of the following analog/digital converting part 120*h*, and outputs the transformed video signal.

The decoder 120*d* decodes the horizontal/vertical synchronous signals(H' and V') which are transmitted from the video signal generating unit 110 through the connector 120*a*, demultiplexes the timing information data which is multiplexed to the vertical synchronous signal(V'), and outputs the de-multiplexed timing information data.

In other words, the decoder 120*d* decodes the horizontal synchronous signal(H') which is transmitted from the video signal generating unit 110 through the connector 120*a* using a clock faster than a clock used in the decoder 120*b*. The decoder 120*d* decodes the vertical synchronous signal(V') as shown in FIG. 4*a*, detects the original vertical synchronous signal(V) as shown in FIG. 4*b*, de-multiplexes the timing information data which is multiplexed to the vertical synchronous signal(V'), and outputs the de-multiplexed timing information data.

Here, the decoder 120*d* detects a number of the rising edge in the vertical synchronous signal(V') and a number of the falling edge of after the vertical synchronous signal(V') is ended using the vertical synchronous signal(V') which is transmitted through the connector 120*a* from the decoder 110*b* of the video signal generating unit 110 as clock signal and the horizontal synchronous signal(H') as enable signal, and decodes the number of the rising edge in the vertical synchronous signal(V') and the number of the falling edge, then may output the original horizontal/vertical synchronous signal(H, V) and the timing information data.

In addition, when the encoding of the encoder 110*b* of the video signal generating unit 110 is performed by using the information line, the decoding of the decoder 120*d* is performed by using the horizontal synchronous signal(H) as clock signal in accordance with a protocol and the decoded result signal is then output.

The synchronous signal processing part 120*e* performs the polarity determination of the horizontal/vertical synchronous signals(H and V) which are transmitted from the decoder 120*d*, the separation of the synchronous signals(H and V) and the analysis of the synchronous signals, and outputs the result signals.

The MICOM 120*f* outputs a control signal for controlling a sampling clock of the phase-locked loop 120*g* using the horizontal/vertical synchronous signals(H, V) of the synchronous signal processing part 120*e* and total number of clock/horizontal line information contained in the timing information data which is output from the decoder 120*e* and outputs a control signal for controlling zoom up/down rates and horizontal/vertical positions of the display signal transforming part 120*i* depending on the total number of horizontal line/vertical period contained in the timing information data.

The phase-locked loop 120*g* generates a sampling clock of SC corresponding to the horizontal synchronous signal (H) which is separated through the synchronous signal processing part 120*e* depending on the control signal of the MICOM 120*f*.

The analog/digital converting part 120*h* converts an analog video signal(ARGB) which is signal-processed by the video signal processing part 120*c* into a corresponding digital video signal(DRGB) to the analog video signal depending on the sampling clock SC of the phase-locked loop 120*g* and outputs the converted digital video signal.

Lastly, the display signal transforming part 120*i* transforms the converted digital video signal(DRGB) which is converted by the analog/digital converting part 120*h* to be matched with an operational property of the display device 120*k* depending on the zoom up/down rates and horizontal/vertical positions of the MICOM 120*f*.

Accordingly, the third interfacing part 120*j* interfaces the display information and displays the interfaced display information on the display device 120K.

Also, the MICOM 120*e* controls the sampling clock of the phase-locked loop 120*f* depending on the output signal of the display signal converting part 120*h* and performs the above described procedures repeatedly.

Next, the operation of a timing information interfacing apparatus in a digital display device in accordance with another embodiment of the present invention is described in detail with reference to the accompanying drawings of FIG. 7, FIG. 8*a* and FIG. 8*b*.

Referring to FIG. 7, first, the video signal generating unit 210 generates a predetermined video signal (R, G and B), horizontal/vertical synchronous signals (H and V), and a timing information, respectively. In other words, the video signal generating part 210*a* of the video signal generating unit 210 outputs a control signal for interfacing the display information of the display unit 220 to the first interfacing part 210*b*. Here, the control signal for interfacing the display information of the display unit 220 may be provided to the first interfacing part 210*c* directly from the CPU(not shown).

The first interfacing part 210*c* interfaces the display information of the display unit 220 depending on the control signal of the video signal generating part 210*a* or the control signal of the CPU.

Accordingly, the video signal generating part 210*a* generates a predetermined video signals(R, G, B), horizontal/vertical synchronous signals(H, V), and the timing information data according to the whole display information of the display unit 220 which has been interfaced through the first interfacing part 210*c*.

Here, the timing information data is comprised of an information data of total clocks carried in the horizontal synchronous signal(H), an information data of a number of total lines carried in the vertical synchronous signal (V), an information data of an active area carried respectively in the horizontal/vertical synchronous signals, and an information data of an active area start.

Then, the encoder 210*b* encodes the video signals(R, G, B), the horizontal/vertical synchronous signals(H, V) and the timing information data all of which are generated from the video signal generating part 210*a*, multiplexes the timing information data to the video signals(R, G, B), and outputs the multiplexed video signals (R', G', B') and the multiplexed horizontal/vertical synchronous signals(H' and V').

Figure 8C:
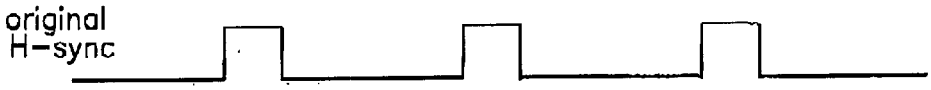
Figure 8D:
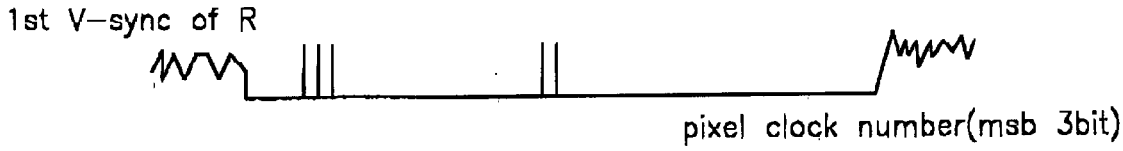
Figure 8E:
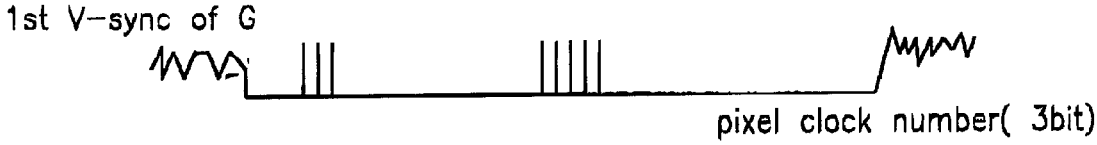
Figure 8F:
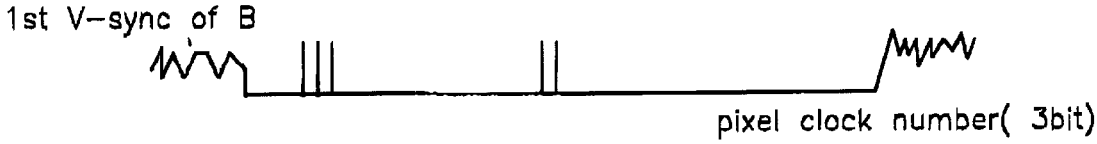
Figure 8G:
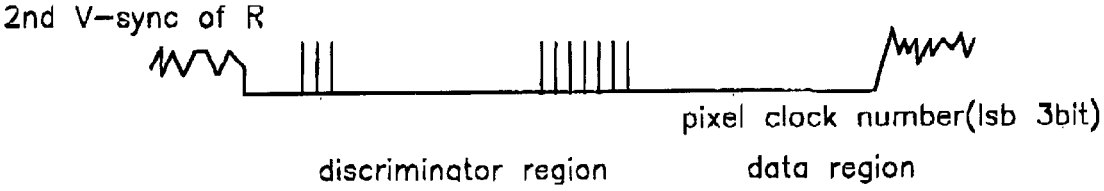

In other words, the encoder 210*b* encodes the video signals(R, G, B) and the horizontal/vertical synchronous signals(H, V) generated from the video signal generating part 210*a*, multiplexes a discriminator region of the timing information data within a delay region for determining the polarity of the vertical synchronous signal of one line by using the horizontal synchronous signal(H) as enable signal as shown in FIGS. 8*a*–8*c*. After the vertical synchronous signal(V) within one line ends, the decoder 210*b* multiplexes the timing information data and outputs the multiplexed timing information data as shown in FIGS. 8*d*–8*g*. Here, since the timing information data is six, it is sufficient to use only three channels. Thus, the display unit 220 processes the video signals(R, G, B) depending on the timing information generated from the video signal generating unit 210 and displays the signal-processed video signals. In other words, the second interfacing part 220*b* of the display unit 220 stores all the display information within the display unit 220 and interfaces the stored display information depending on the control signal of the video signal generating unit 210.

Thereafter, the decoder 220*c* decodes the video signals(R', G', B') and the horizontal/vertical synchronous signals(H' and V') all of which are transmitted from the video signal generating unit 210 through the connector 220*a*, demultiplexes the timing information data which is multiplexed to the video signals(R', G', B'), and outputs the de-multiplexed video signals(R, G, B), the demultiplexed horizontal/vertical synchronous signals(H', V'), and the timing information data.

In other words, the decoder 220*c* decodes the vertical synchronous signals(V,V') which is transmitted from the decoder 210*b* of the video signal generating part 210 through the connector 220*a* using a mux select signal and the horizontal synchronous signals(H,H') using a flip flop(f/f) enable signal, and then outputs the decoded original horizontal/vertical synchronous signals(H, V) and the timing information data.

The video signal processing part 220*d* outputs the video signals(R, G, B) which is input from the video signal generating part 210*a* of the video signal generating unit 210 through the connector 220*a* and is then signal-processed to correspond to an input level of the analog/digital converting part 220*h*.

Then, the synchronous signal processing part 220*e* performs the polarity determination of the horizontal/vertical synchronous signals(H and V) which are transmitted from the decoder 220*c*, the separation of the synchronous signals(H and V) and the analysis of the synchronous signals, and outputs the result signals.

The MICOM 220*f* outputs a control signal for controlling a sampling clock of the phase-locked loop 220*g* using the horizontal/vertical synchronous signals(H, V) of the synchronous signal processing part 220*e* and total number of clock/horizontal line information contained in the timing information data which is output from the decoder 220*e* and outputs a control signal for controlling zoom up/down rates and horizontal/vertical positions of the display signal transforming part 220*i* depending on the total number of horizontal line/vertical period contained in the timing information data.

The phase-locked loop 220*g* generates a sampling clock corresponding to the horizontal synchronous signal(H) which is separated through the synchronous signal processing part 220*e* depending on the control signal of the MICOM 220*f*.

The analog/digital converting part 220*h* converts an analog video signal (ARGB) which is signal-processed by the video signal processing part 220*d* into a corresponding digital video signal(DRGB) to the analog video signal depending on the sampling clock of the phase-locked loop 220*g* and outputs the converted digital video signal.

The display signal transforming part 220*i* transforms the converted digital video signal (DRGB) which is converted by the analog/digital converting part 220*h* to be matched with an operational property of the display device 220*k* depending on the zoom up/down rates and horizontal/vertical positions of the MICOM 220*f*, and outputs the transformed result signal.

Also, the MICOM 220*e* controls the sampling clock of the phase-locked loop 220*f* depending on the output signal of the display signal converting part 220*i* and performs the above described procedures repeatedly.

As described previously, the timing information interfacing apparatus of the digital display device according to the present invention makes the timing information of the video signal generating unit transmitted with a format of the timing information which is requested by the display apparatus using the digital display device and thereby the apparatus can supply and receive indispensable information such as resolution, clock number/horizontal period, number of horizontal line/vertical period, horizontal and vertical active position etc. As a result, precise display can be accomplished.

It will be apparent to those skilled in the art that various modifications and variations can be made in the timing information interfacing apparatus of the digital display device according to the present invention without departing from the spirit or scope of the invention. Thus, it is intended that the present invention covers the modifications and variations of the invention provided they come within the scope of the appended claims and their equivalents.

What is claimed is:

1. A video signal generating unit in communication with a display unit, wherein the video signal generating unit comprises:

a video signal generating part for generating at least one synchronous signal and timing information data; and an encoder in communication with the video signal generating part for encoding the synchronous signal which is output from the video signal generating part and outputting a multiplexed synchronous signal in which the timing information data is multiplexed with the at least one synchronous signal; and wherein the display unit comprises:

a decoder for decoding the multiplexed synchronous signal of the encoder to separate the at least one synchronous signal and the timing information data from the multiplexed synchronous signal and then outputting the timing information data; and a controller responsive to the timing information data for controlling a sampling clock of a phase-locked loop and zoom up/down rates and horizontal/vertical positions of a display signal transforming part depending on the timing information data which is output from the decoder;

wherein, the video signal generating part generates the timing information data comprising information data about total clocks, number of total lines, an active area, and an active area start; and wherein the information data of total clocks is carried in a horizontal synchronous signal, the information data of the number of total lines is carried in a vertical synchronous signal, the information data of the active area and the active area start are carried in the horizontal/vertical synchronous signals and the video signal generating unit generates accurate video timing to produce a smooth seamless flow of synchronized video.

2. The apparatus of claim 1, wherein the controller controls a sampling clock of the phase-locked loop using the information data of the number of total clocks.

3. The apparatus of claim 1, wherein the controller controls the zoom up/down rates and the horizontal/vertical positions of the display signal transforming part depending on at least one of the information of the number of total lines and the active area which is contained in the timing information data.

4. The apparatus of claim 1, wherein the timing information data is carried in the vertical synchronous signal which is generated in the video signal generating unit.

5. The apparatus of claim 1, wherein the timing information data is carried in a video signal which is generated in the video signal generating unit.

6. The apparatus of claim 1, wherein the timing information data is carried in a new line formed between the video signal generating unit and the display unit.

7. A video signal generating unit in communication with a display unit, wherein the video signal generating unit comprises:

a video signal generating part for generating at least one synchronous signal and timing information data;

an encoder communicating with the video signal generating part for encoding a video signal, the at least one synchronous signal, and a timing information data which are respectively output from the video signal generating part and outputting a multiplexed video and synchronous signal in which the timing information data is multiplexed therein; and wherein the display unit comprises:

a decoder for decoding the multiplexed video and synchronous signal of the encoder to separate the at least one synchronous signal and the timing information data from the multiplexed video and synchronous signal and then outputting the timing information data carried in the original video signal and the original synchronous signal; and a controller responsive to the timing information data for controlling a sampling clock of a phase-locked loop and zoom up/down rates and horizontal/vertical positions of a display signal transforming part depending on the timing information data which is output from the decoder;

wherein, the video signal generating part generates the timing information data comprising information data about total clocks, number of total lines, an active area, and an active area start; and wherein the information data of total clocks is carried in a horizontal synchronous signal, the information data of the number of total lines is carried in a vertical synchronous signal, the information data of the active area and the active area start are carried in the horizontal/vertical synchronous signals and the video signal generating unit generates accurate video timing to produce a smooth seamless flow of synchronized video.

8. The apparatus of claim 7, further comprising:

a video signal processing part for transforming the video signal which is output from the video signal generating part into a transformed video signal with a predetermined level and outputting the transformed video signal having the predetermined level;

a synchronous signal processing part for performing polarity determination of horizontal/vertical synchronous signals and the separation of the horizontal/vertical synchronous signals and then outputting the resultant signals;

the phase-locked loop for generating the sampling clock corresponding to the horizontal synchronous signal which is separated through the synchronous signal processing part in response to the controller;

an analog/digital converting part for converting an analog video signal which is signal-processed in the video signal processing part to a corresponding digital video signal to the analog video signal depending on the sampling clock of the phase-locked loop.

9. The apparatus of claim 7, wherein the controller controls the sampling clock applied to the phase-locked loop using number of total clock and horizontal line which is contained in the timing information data and controls the zoom up/down rates and horizontal/vertical positions of the display signal transforming part depending on information of number of total vertical lines and a vertical period and an active area which is contained in the timing information data.

10. The apparatus of claim 8, wherein the controller controls the sampling clock applied to the phase-locked loop using number of total clock and horizontal line which is contained in the timing information data and controls the zoom up/down rates and horizontal/vertical positions of the display signal transforming part depending on information of number of total vertical lines and a vertical period and an active area which is contained in the timing information data.

* * * * *